US007384306B2

(12) United States Patent
Malstrom et al.

(10) Patent No.: US 7,384,306 B2
(45) Date of Patent: Jun. 10, 2008

(54) RF CONNECTOR WITH ADJACENT SHIELDED MODULES

(75) Inventors: Charles Randall Malstrom, Lebanon, PA (US); Sean Patrick McCarthy, Palmyra, PA (US); Alexandra Lynne Matthews Spitler, Palmyra, PA (US); John Joseph Consoli, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/493,303

(22) Filed: Jul. 26, 2006

(65) Prior Publication Data

US 2008/0026612 A1 Jan. 31, 2008

(51) Int. Cl.
*H01R 9/05* (2006.01)

(52) U.S. Cl. ..... 439/578; 439/63; 439/394; 439/579; 439/701; 439/879

(58) Field of Classification Search ..... 439/579, 439/585, 508, 610, 578, 63, 701, 879
See application file for complete search history.

(56) References Cited

U.S. PATENT DOCUMENTS

| | | | | |
|---|---|---|---|---|
| 4,914,062 | A * | 4/1990 | Voltz | 439/608 |
| 6,083,048 | A * | 7/2000 | Yamaguchi | 439/608 |
| 6,135,815 | A * | 10/2000 | Ko et al. | 439/607 |
| 6,210,223 | B1 * | 4/2001 | Aoyama et al. | 439/585 |
| 6,384,335 | B1 * | 5/2002 | Saito et al. | 174/74 R |
| 6,533,609 | B2 * | 3/2003 | Koide | 439/578 |
| 6,746,277 | B2 | 6/2004 | Laub et al. | |
| 6,821,150 | B2 | 11/2004 | Hall et al. | |
| 6,840,822 | B1 | 1/2005 | Hall et al. | |

* cited by examiner

*Primary Examiner*—Neil Abrams

(57) ABSTRACT

An electrical connector includes a shield having opposed planar side panels. The shield is configured to receive a shield of a mating connector within the side panels. A dielectric is attached to the shield. The dielectric is configured to receive the coaxial cable and the shield is electrically connected to an outer conductor of the coaxial cable. The side panels are configured to abut and engage side panels of an adjacent connector with a substantially flush fit to form a row of connectors to be located in an outer housing. A separate strain relief member may be attached to the shield. Each of the shield and the strain relief member may include an IDC feature that pierces the cable insulation.

17 Claims, 10 Drawing Sheets

RF CONNECTOR WITH ADJACENT SHIELDED MODULES

BACKGROUND OF THE INVENTION

The invention relates generally to coaxial cable connectors, and more particularly to a coaxial cable connector assembly suitable for use in multi-connector RF assemblies.

Generally, coaxial cables have a circular geometry formed with a central conductor (of one or more conductive wires) surrounded by a cable dielectric material. The dielectric material is surrounded by a cable braid (of one or more conductive wires) that serves as a ground, and the cable braid is surrounded by a cable jacket. In most coaxial cable applications, it is preferable to match the impedance between source and destination electrical components located at opposite ends of the coaxial cable. Consequently, when sections of coaxial cable are interconnected by connector assemblies, it is preferable that the impedance remain matched through the interconnection.

Today, coaxial cables are widely used. Recently, demand has risen for radio frequency (RF) coaxial cables in applications such as personal computers and wireless networks. In addition, there is an increased demand for RF coaxial cables in the automotive industry, which is due, in part, to the increased electrical content within automobiles, such as cellular phones, GPS, satellite radios, Bluetooth® compatibility systems and the like. The wide applicability of coaxial cables demands that connected coaxial cables maintain the impedance at the interconnection.

Coaxial cables are used in making single line-to-line connections and also in multi-connector applications such as stripline applications. For example, coaxial connectors are commonly used in making board mounted antenna to communication device connections. However, with the ongoing trends for miniaturization and space conservation in electronic systems, it may be anticipated that current connection strategies may not meet the centerline-to-centerline communication device to antenna spacing requirements in the near future. Thus there is a need for a connector design and mating strategy that reduces centerline spacing for stripline applications.

BRIEF DESCRIPTION OF THE INVENTION

In one aspect, an electrical connector for a coaxial cable is provided. The connector includes a shield having opposed planar side panels. The shield is configured to receive a shield of a mating connector within the side panels. A dielectric is attached to the shield. The dielectric is configured to receive the coaxial cable and the shield is electrically connected to an outer conductor of the coaxial cable. The side panels are configured to abut and engage side panels of an adjacent connector with a substantially flush fit.

Optionally, each side panel of the shield includes a tab and a gap. The tab including an outward flare that is received in the gap of an adjacent side panel of an adjacent shield. The side panels also include a dimple configured to assure electrical connectivity with a shield of a mating connector. The connector further includes an outer housing that receives the shield and the dielectric, and a cable strain relief that retains the coaxial cable to the dielectric. The strain relief includes a tab configured to inhibit rocking of the shield and dielectric within the housing. The dielectric is configured to interlock with an adjacent dielectric. The connector is configured to carry RF signals.

In another aspect, a connector assembly for making coaxial cable connections is provided. The assembly includes a first connector including a first housing holding a signal and a ground contact. The ground contact includes a shield having substantially planar opposed side panels. A second housing is matable to the first housing. The second housing holds a second connector including a shield having opposed planar side panels and a dielectric attached to the shield. The side panels are configured to abut and engage side panels of an adjacent second connector with a substantially flush fit even when the first and second housings are mated.

DETAILED DESCRIPTION OF THE INVENTION

Figure 1:
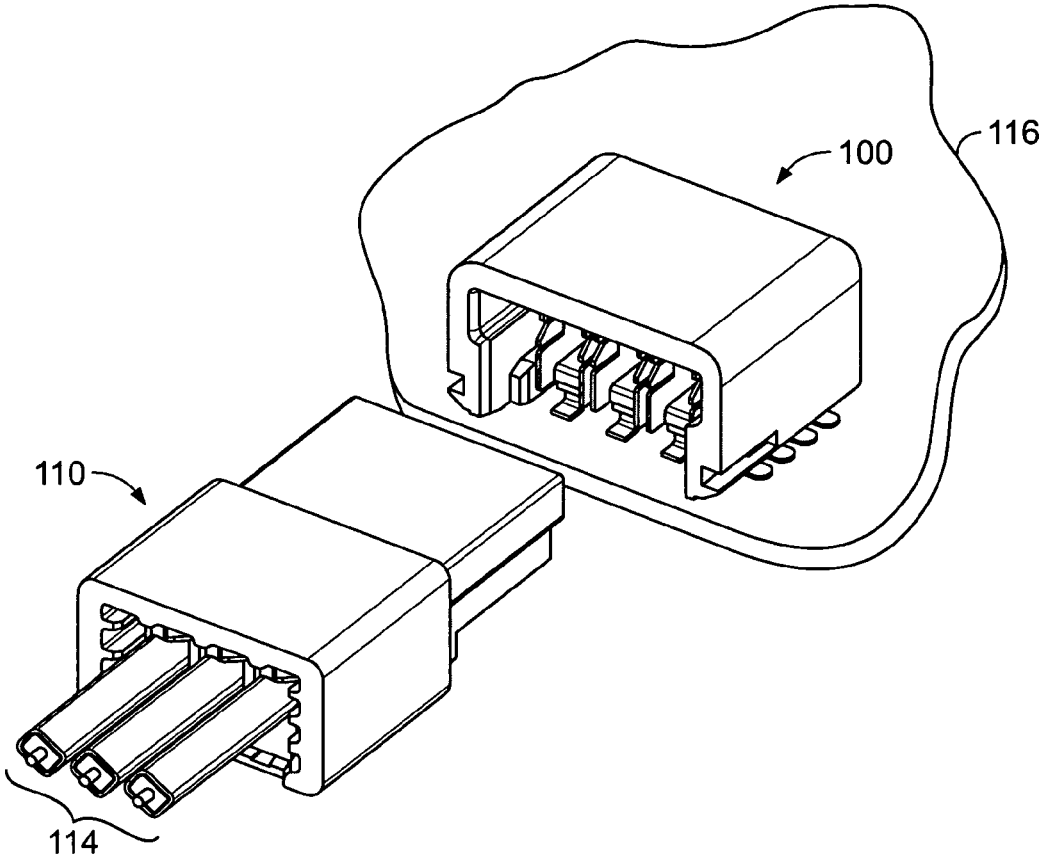
FIG. 1 is a perspective view of a receptacle assembly and a mating plug assembly formed in accordance with an exemplary embodiment of the present invention.

FIG. 1 is a perspective view of a receptacle connector assembly 100 and a mating plug connector assembly 110 formed in accordance with an exemplary embodiment of the present invention. As shown in FIG. 1, the receptacle and plug assemblies 100 and 110 are formed as a three-circuit connector assembly. Each circuit is associated with one of three coaxial cables 114 terminated to the plug assembly 110. It is to be understood however, that the configuration shown is for example only and no limitation is intended thereby. The receptacle and plug assemblies 100, 110 may be fabricated to provide any number of connections in the side by side arrangement shown. Similarly, the receptacle assembly 100 though illustrated as a board mount receptacle assembly attached to a circuit board 116, may also be used in a cable-to-cable or wire-to-wire design. The circuits may carry RF signals. The receptacle and plug assemblies 100, 110 provide a minimized centerline spacing between adjacent connectors as will be described.

Figure 2:
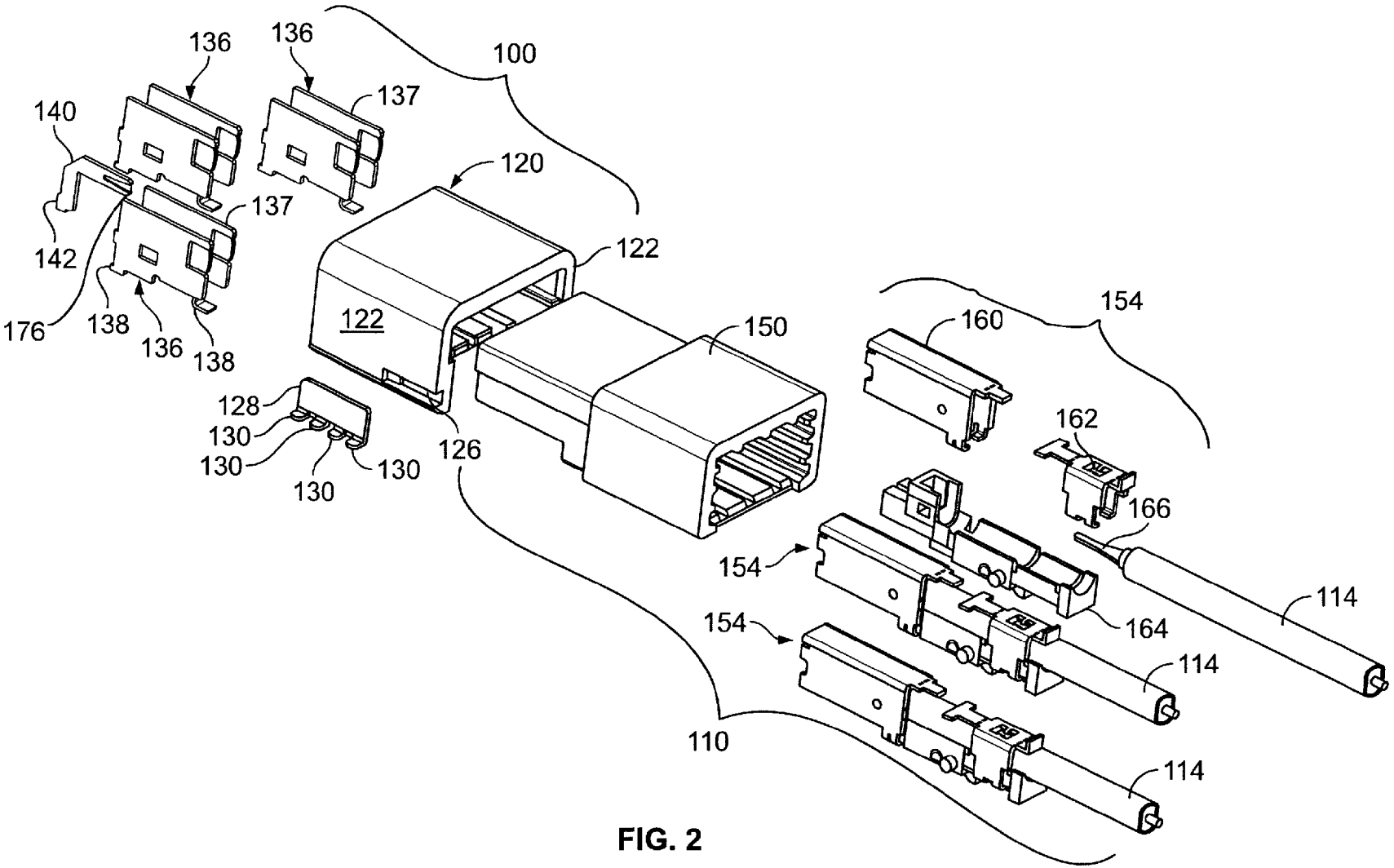
FIG. 2 is an exploded view of the receptacle and plug assemblies shown in FIG. 1.

FIG. 2 illustrates an exploded view of the receptacle and plug assemblies 100 and 110. The receptacle assembly 100 includes a dielectric housing 120 having opposed sides 122. Each side 122 includes a slot 126 that receives a mounting tab 128. The mounting tab 128 has a number of solder pads 130 that enable the housing 120 to be mounted on the circuit board 116 (FIG. 1). The interior housing dielectric (not shown) includes channels that receive U-shaped shields 136. The shields 136 have substantially planar opposed sides 137 formed with feet 138 to electrically connect the shields 136 to the circuit board 116. A contact 140, only one of which is shown, is positioned within each shield 136 and held in place by the interior housing dielectric. Each contact 140 also has a foot 142 to electrically connect the contact 140 to the circuit board 116.

The plug assembly includes an outer housing 150 that holds a number of plug connectors 154. Each plug connector 154 includes a plug shield 160, a cable strain relief 162, a dielectric 164 and a contact 166 that is attached to a cable 114.

Figure 3:
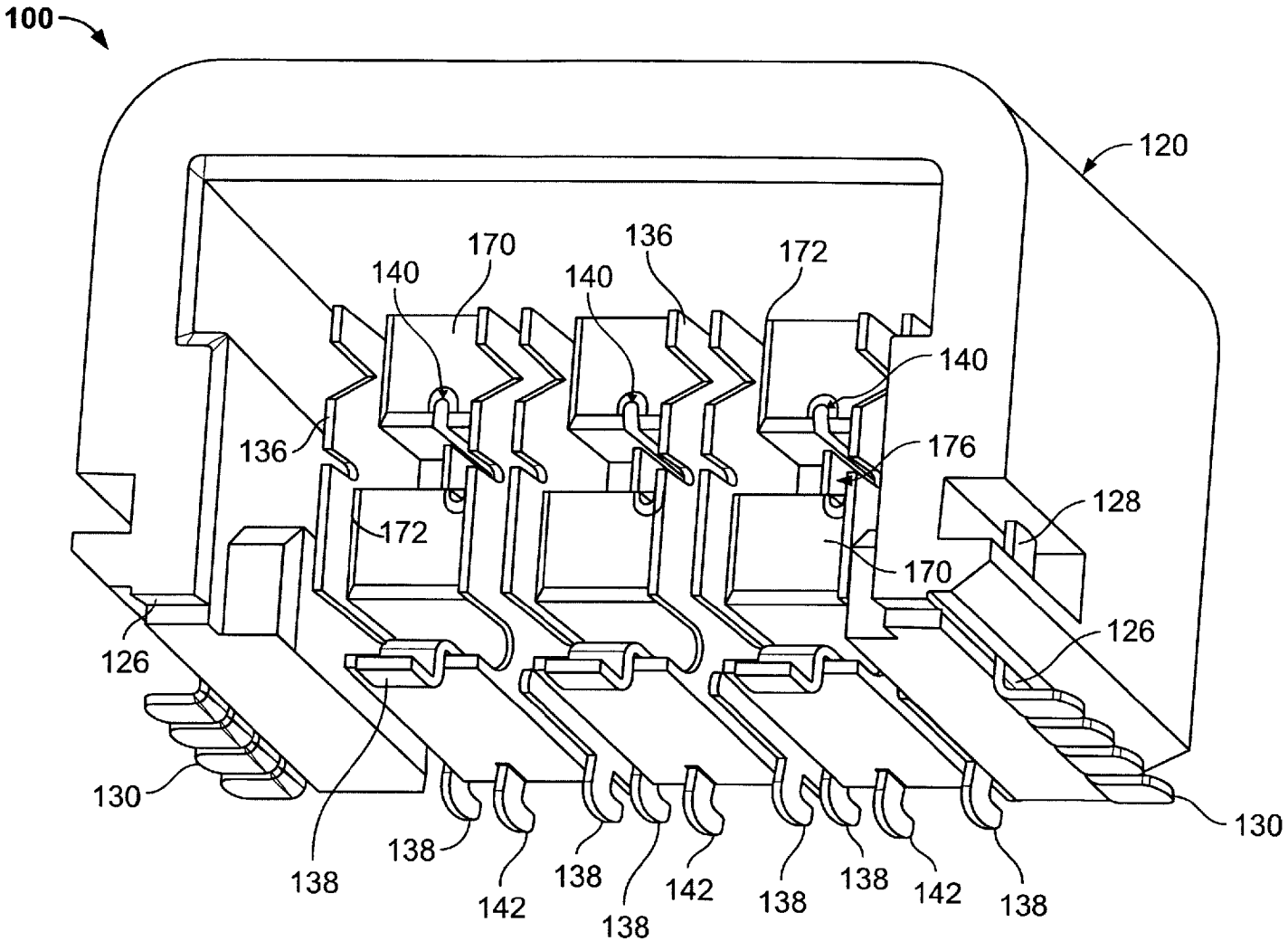
FIG. 3 is an enlarged perspective view of the receptacle assembly shown in FIG. 1.

FIG. 3 illustrates an enlarged perspective view of the completed receptacle assembly 100. The receptacle housing includes an interior dielectric 170 that includes channels 172 that locate the shields 136 and the receptacle contact 140. The receptacle and plug center contact system in one embodiment is a blade and clip configuration where the exposed mating end of the receptacle contact 140 includes a clip portion 176 that makes electrical contact with the blade of the contact 166 of the mating plug connector 110. The shields 136 are fabricated from a metallic material. The feet 138 of the shields 136 and the feet 142 of the contacts 140 extend from the bottom of the housing 120 for making electrical connections to the circuit board 116 (FIG. 1). The solder pads 130 of the mounting tabs 128 extend from the slot 126 to mechanically attach and mount the housing 120 to the circuit board 116. The mounting tab 128 slides into the slot 126 from the rear of the housing 120 and engages a retention feature (not shown) that holds mounting tab 128 in place in the housing 120.

Figure 4:
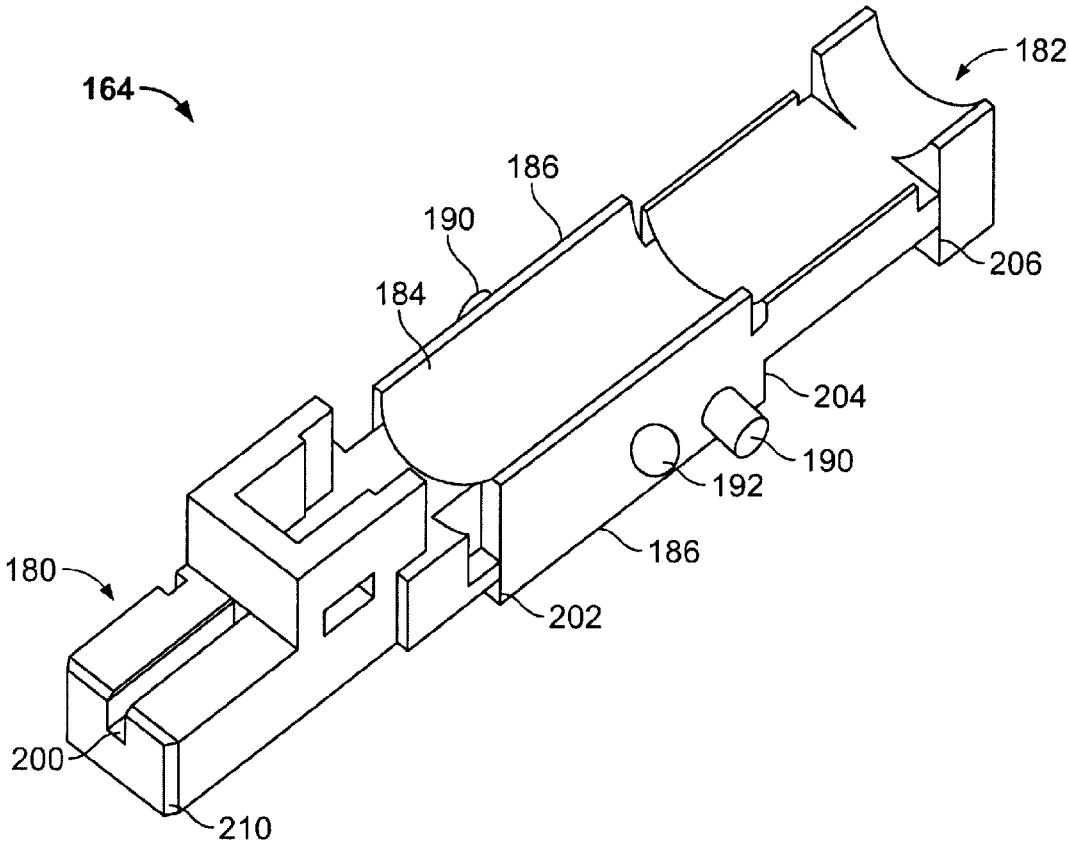
FIG. 4 illustrates a perspective view of a dielectric shown in FIG. 2.
Figure 5:
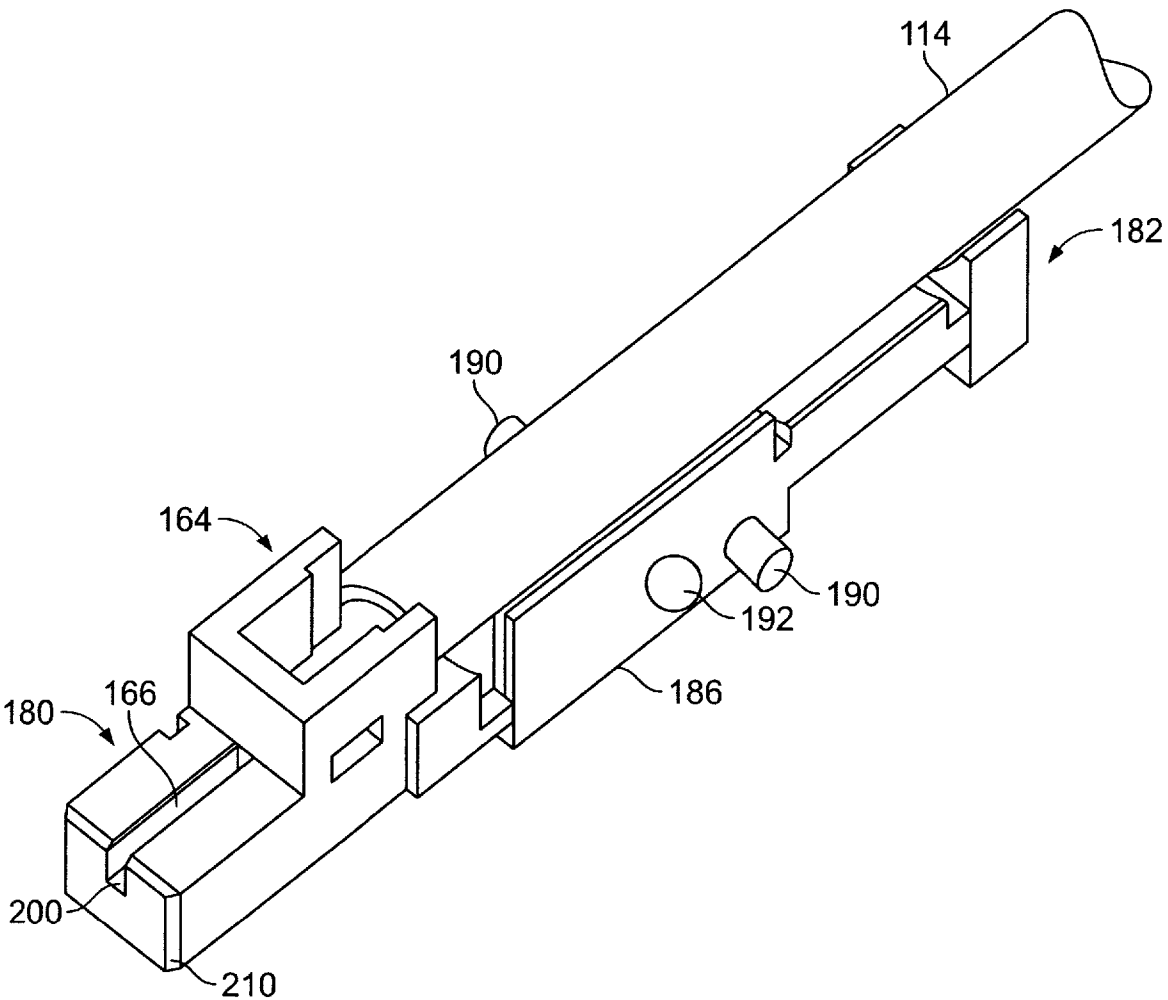
FIG. 5 is a perspective view of a dielectric with a cable positioned for attachment.

FIG. 4 illustrates a perspective view of the dielectric 164. FIG. 5 is a perspective view of the dielectric 164 with a cable 114 positioned for attachment to the dielectric 164. The dielectric 164 includes a contact end 180 and a cable receiving end 182. A cable cradle 184 is formed between sides 186. A keying element 190 and a keying receptacle 192 are formed on each side 186. The keying element 190 and keying receptacle 192 are complementary in size and shape and are positioned so that the keying element 190 on one dielectric 164 is received in the keying receptacle 192 of an adjacent dielectric 164 to interlock the dielectrics when multiple dielectrics 164 are stacked together. The keying element/keying receptacle system positions adjacent dielectrics 164 relative to one another and adds stability to the arrangement. In an exemplary embodiment, the keying element 190 is a circular pin and the keying receptacle 192 is a circular hole. It is to be understood, however that these elements may take other shapes such as square, oval, star, as well as irregular but complementary shapes. A contact channel 200 is provided at the contact end 180 to position, align and support the contact 166 when the contact 166 is attached to the center conductor (not shown) of the cable 114 receptacle. In an exemplary embodiment, the contact 166 is a blade contact used with the clip and blade contact configuration previously described. The dielectric 164 also includes locating surfaces 202, 204, and 206 that position and align the shield 160 and the cable strain relief 162, on the dielectric as will be described. Chamfered edges 210 are formed on the contact end 180 of the dielectric 164 to provide guidance for the shield 136 of the receptacle connector 100 during mating.

Figure 6:
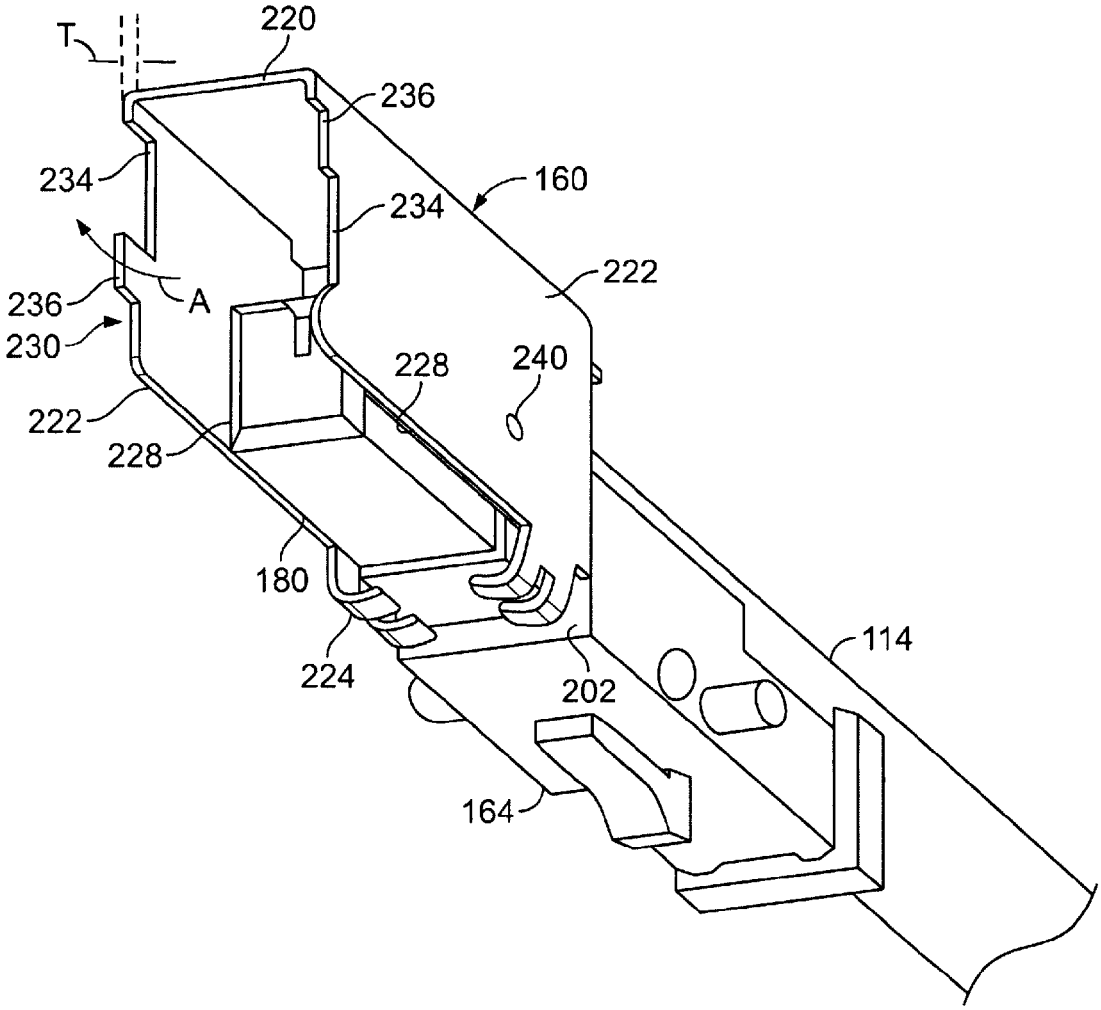
FIG. 6 is a perspective view of a dielectric joined to a shield.

FIG. 6 illustrates the dielectric 164 joined to the shield 160. The shield 160 includes a top side 220 and opposed planar side panels 222 that extend downwardly from the top side 220. The side panels 222 abut the locating surface 202 of the dielectric 164 to aid in positioning the shield 160 on the dielectric 164. A number of clamping fingers 224 extend from the side panels 222 and clamp around and crimp onto the dielectric 164 to attach the shield 160 to the dielectric 164. The shield 160 also has an insulation displacement contact (IDC) in a rear panel (not shown) that pierces the cable insulation to establish an electrical connection or IDC braid termination with the cable braid. The IDC also firmly attaches the shield 160 to the cable 114. The shield 160 is attached to the dielectric 164 in a manner that maintains a clearance 228 between the side panels 222 and the contact end 180 of the dielectric 164. The shields 136 (FIG. 2) of the receptacle assembly 100 are received in the clearances 228 in a telescoping manner when the receptacle and plug assemblies 100, 110 are mated. That is, both sides 137 of each shield 136 of the receptacle assembly 100 are received within the side panels 222 of the shield 160 of the mating plug connector 154 when the receptacle and plug assemblies 100,110 are mated.

A forward end 230 of each side panel 222 includes a gap 234 and a tab 236. The tab 236 has a slightly outward flare, in the direction of the arrow A, which also provides guidance for a mating shield 136. The outward flare of the tab 236 is no more than one thickness T of the side panel material. Each tab 236 is configured to fit within the gap 234 of an adjacent shield 160 when the plug connectors 154 are in a stacked arrangement. The flare of the tab 236 is limited so that the side panels 222 of adjacent shields 160 fit flush against one another. The shields 160 are fabricated from a metallic material and in one embodiment, each tab 236 includes chamfered and coined edges for improved guidance during mating with receptacle shields 136. A dimple 240 is also formed in each side panel to assure that there is reliable electrical contact between the shields 160 and 136 when mated.

Figure 7:
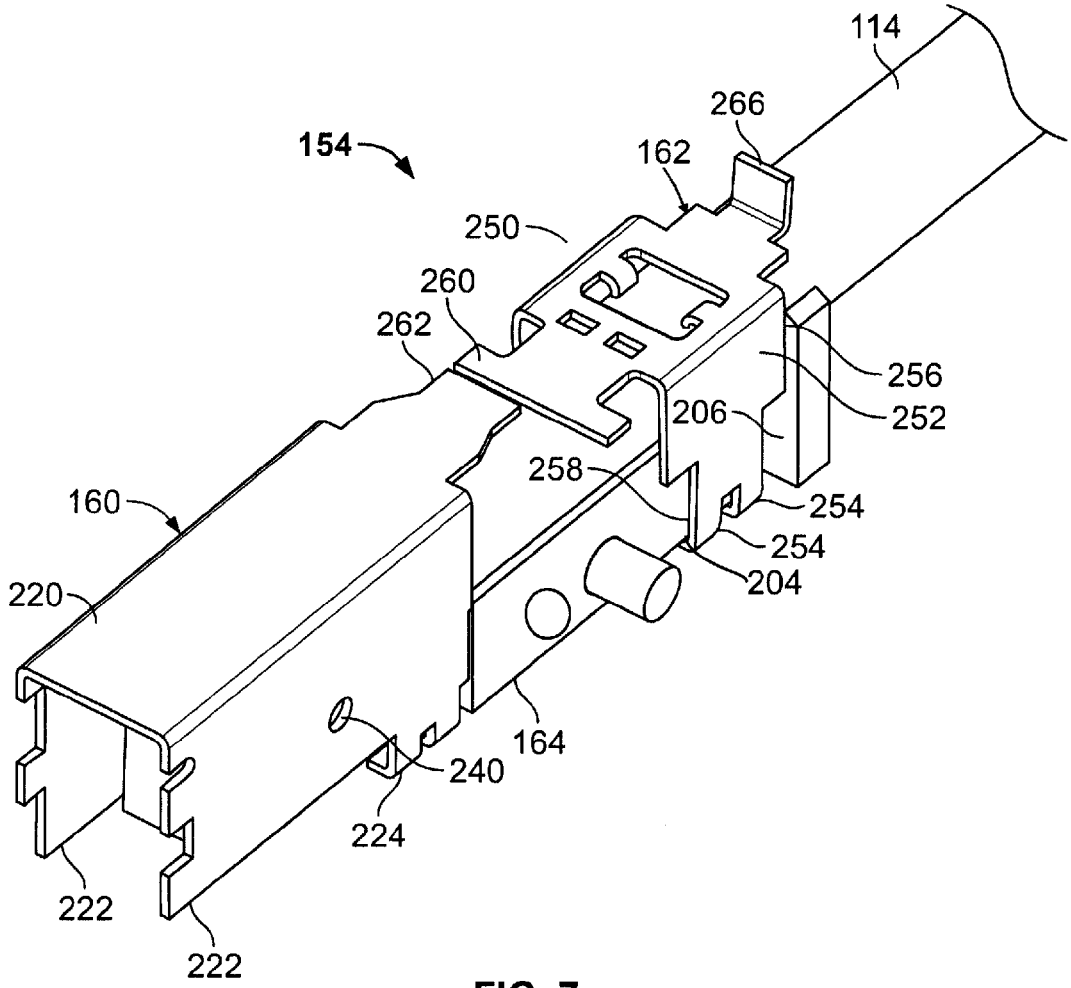
FIG. 7 is a perspective view of an individual plug connector.

FIG. 7 illustrates the dielectric 164 joined to the shield 160 and the cable strain relief 162 forming a completed plug connector 154. The cable strain relief 162 is a metallic member and is formed with a top section 250 and downwardly extending side sections 252. One or more clamping fingers 254 extend from the side sections 252 and clamp around the dielectric 164 and crimp onto the dielectric 164 to firmly retain the cable 114 on the dielectric 164. The cable strain relief 162 is positioned such that a rearward edge 256 and a forward edge 258 are between locating surfaces 204 and 206 on the dielectric 164. In some embodiments, the cable strain relief 162 may also include an IDC type feature wherein at least one edge, such as the edge 256, pierces the insulation of the cable 114 to add additional resistance against separation of the cable 114 from the dielectric 164. In such embodiments, the cable strain relief 162 may or may not make contact with the cable braid.

The cable strain relief 162 is formed with a forward extension 260 that is positioned proximate a rearward extension 262 on the shield 160. These extensions 260, 262 do not engage one another. An upward tab 266 acts as a stop that inhibits any upward/downward rocking motion between the plug connector 154 and the outer housing 150 when the plug connector 154 is installed in the outer housing 150.

Figure 8:
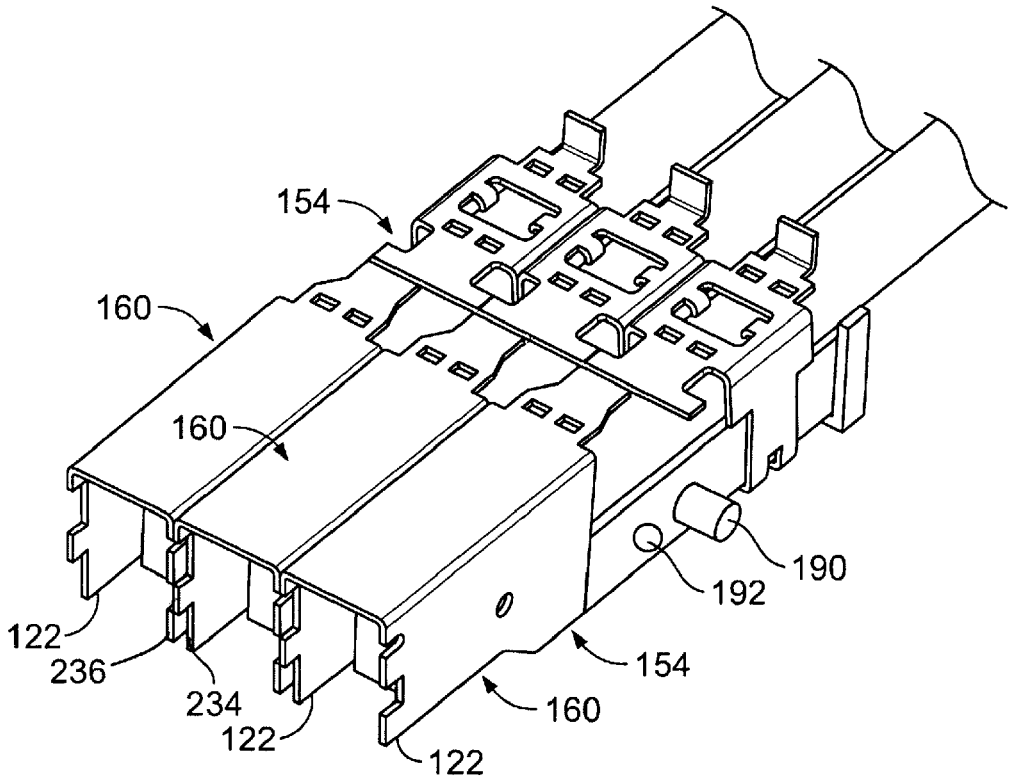
FIG. 8 is a perspective view of multiple plug connectors together in a side-by-side arrangement.
Figure 9:
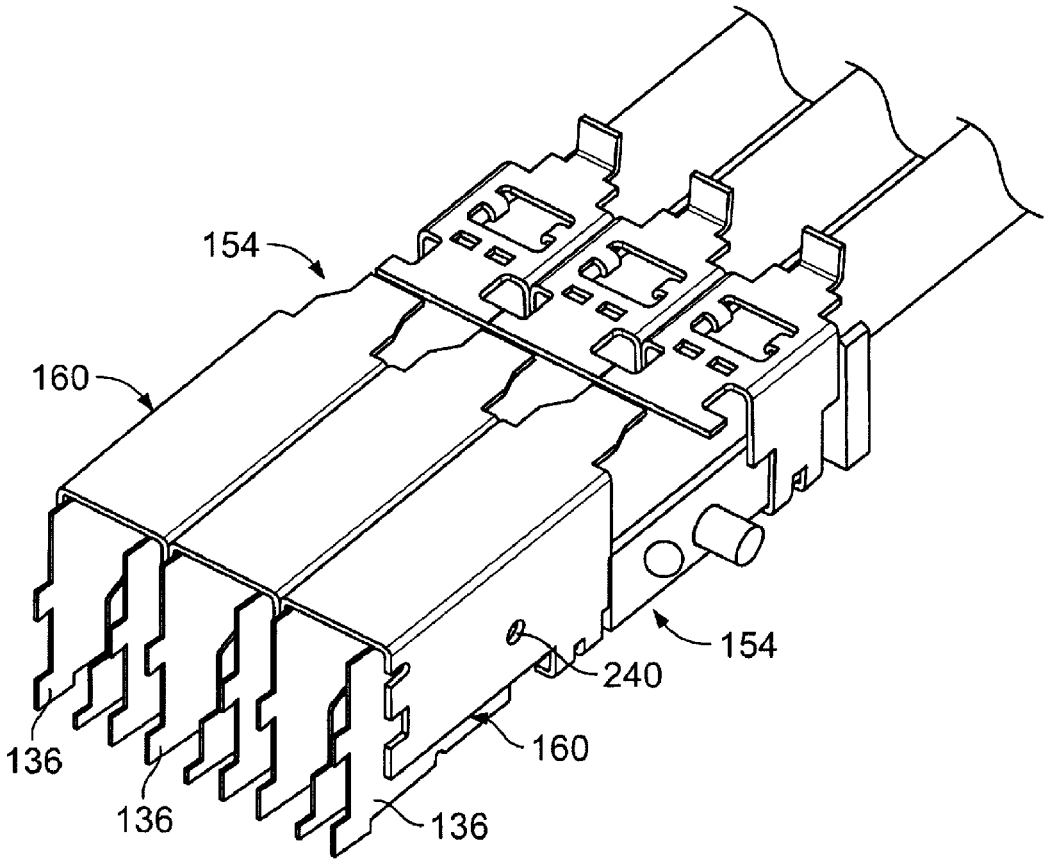
FIG. 9 is a perspective view of mated receptacle and plug assemblies with the outer housings removed.

FIG. 8 illustrates a perspective view of multiple plug connectors 154 together in a side-by-side arrangement with the outer housing 150 removed. FIG. 9 illustrates a perspective view of mated receptacle and plug assemblies 100 and 110, respectively, with the outer housings 120 and 150 removed. As illustrated, the stacked assembly includes three plug connectors 154. The shields 160 are adjacent one another in a flush fitting arrangement accomplished by the meshing together of the gaps 234 and tabs 236 of adjacent shield side panels 122. The keying elements 190 on the interior sides of the dielectrics 164 are received in adjacent keying receptacles 192 of the neighboring dielectrics 164 such that the dielectrics 164 are interlocked together. The external keying elements 190 are received in slots (not shown) in the outer housing 150.

In the mated assembly of FIG. 9, the receptacle connector shields 136 are received within the plug connector shields 160 in a telescoping manner. The shields 136 and 160 are electrically engaged with one another forming a common ground connection. Contact between the inner (receptacle) and outer (plug) shields 136 and 160 is enhanced by the presence of the dimples 240 on the outer shields 160.

Figure 10:
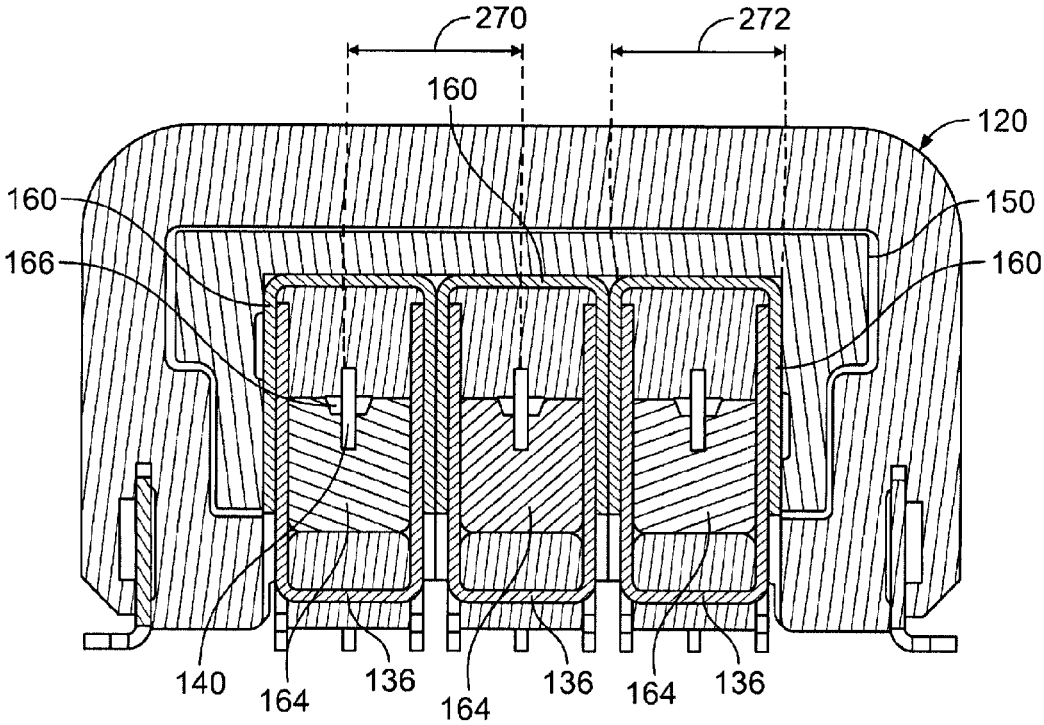
FIG. 10 is a cross-sectional view of mated receptacle and plug assemblies taken through the receptacle housing.

FIG. 10 illustrates a cross-sectional view of mated receptacle and plug assemblies 100 and 110 taken through the receptacle housing 120. Mating is achieved by insertion of the plug assembly 110 into the receptacle housing 120. As the assemblies 100 and 110 are mated, the leading edges of the tabs 236 of the plug shields 160 engage outside edges of the receptacle shields 136. The plug shields 160 slide over the receptacle shields 136 to receive the receptacle shields 136. At the same time, the inside leading edges of the receptacle shields 136 engage the chamfered edges 210 of the dielectrics 164 so that the dielectrics 164 are received within the receptacle shields 136. This brings the plug blade contacts 160 into engagement with the clip contacts 140 in the receptacle assembly 100. A common ground is established through the contact between the shields 160 and 136. The mated assemblies 100, 110 exhibit a minimum centerline spacing 270 that is substantially the same as an outside width 272 of an individual plug shield 160.

The embodiments thus described provide a cost effective connector design that may be used in stripline applications requiring minimal centerline spacing. The centerline spacing is substantially determined by the outside width of an individual plug connector shield 160. Shields 136 of the receptacle connector assembly 100 are received telescopic fashion within the shields of the plug assembly 110. Adjacent tabs 236 and gaps 234 on the plug connector shields 160 along with adjacent keying elements 190 and keying receptacles 192 on the dielectrics 164 stabilize the stacked plug connectors 154 while allowing a flush fit side-to-side of adjacent plug connector shields 160.

While the invention has been described in terms of various specific embodiments, those skilled in the art will recognize that the invention can be practiced with modification within the spirit and scope of the claims.

What is claimed is:

1. An electrical connector for a coaxial cable, said connector comprising:

a shield having opposed planar side panels, each said side panel includes a tab and a gap, said tab including an outward flare that is received in the gap of an adjacent side panel of an adjacent shield, said shield being configured to receive a shield of a mating connector within said side panels; and a dielectric attached to said shield, said dielectric configured to receive the coaxial cable and said shield being electrically connected to an outer conductor of the coaxial cable, and wherein said side panels are configured to abut and engage side panels of an adjacent connector with a substantially flush fit.

2. The connector of claim 1, wherein each said side panel includes a dimple configured to assure electrical connectivity with a shield of a mating connector.

3. The connector of claim 1 further comprising an outer housing that receives said shield and said dielectric.

4. The connector of claim 1 further comprising an outer housing that receives said shield and said dielectric and a cable strain relief that retains the coaxial cable to said dielectric, said strain relief including a tab configured to inhibit rocking of said shield and dielectric within said housing.

5. The connector of claim 1, wherein said dielectric is configured to interlock with an adjacent dielectric.

6. The connector of claim 1, wherein said dielectric includes a keying element and a keying receptacle, said keying element configured to be received in a keying receptacle of an adjacent dielectric, and said keying receptacle being configured to receive a keying element of an adjacent dielectric.

7. The connector of claim 1, wherein an outside width of said shield establishes a minimum centerline spacing between adjacent connectors.

8. The connector of claim 1 further comprising a cable strain relief that retains the coaxial cable to said dielectric, and wherein said dielectric includes locating surfaces for said shield and said strain relief.

9. A connector assembly for making coaxial cable connections, said connector assembly comprising:

a first connector comprising a first housing holding a signal and a ground contact, said ground contact comprising a shield having substantially planar opposed side panels;

a second housing matable to said first housing, said second housing holding a second connector comprising a shield having opposed planar side panels and a dielectric attached to said shield, and wherein said side panels are configured to abut and engage side panels of an adjacent second connector with a substantially flush fit, and wherein each said side panel of said second connector shield includes a tab and a gap, said tab including an outward flare that is received in the gap of an adjacent side panel of an adjacent shield.

10. The connector assembly of claim 9, wherein at least one of said first and second connectors is attached to a coaxial cable.

11. The connector assembly of claim 9, wherein said shield of said first connector is received within said side panels of said shield of said second connector.

12. The connector assembly of claim 9, wherein said first connector is configured to be mounted to a circuit board.

13. The connector assembly of claim 9, wherein said dielectric of said second connector is configured to receive the coaxial cable and said shield of said second connector is configured to be electrically connected to an outer conductor of the coaxial cable.

14. The connector assembly of claim 9, wherein said second connector is configured to be attached to a coaxial cable and said second connector further comprises a cable strain relief that retains the coaxial cable to the dielectric of said second connector, said strain relief including a tab configured to inhibit rocking of said second connector in said second housing.

15. The connector assembly of claim 9, wherein said connector assembly carries an RF signal.

16. The connector assembly of claim 9, wherein said dielectric of said second connector includes a keying element and a keying receptacle, said keying element configured to be received in a keying receptacle of an adjacent dielectric, and said keying receptacle being configured to receive a keying element of an adjacent dielectric.

17. The connector assembly of claim 9, wherein an outside width of said shield of said second connector establishes a minimum centerline spacing between adjacent connectors.

* * * * *